United States Patent [19]

Broemmelsiek

[11] 4,078,291

[45] Mar. 14, 1978

[54] PORTABLE RIVET ANVIL

[76] Inventor: Ruth E. Broemmelsiek, Chabanel, R.R. 1, Defiance, Mo. 63341

[21] Appl. No.: 728,799

[22] Filed: Oct. 1, 1976

[51] Int. Cl.[2] ..... B23Q 7/04

[52] U.S. Cl. ..... 29/283; 72/479

[58] Field of Search ..... 29/283, 243.53, 243.54, 29/243.52; 72/479, 481

[56] References Cited

U.S. PATENT DOCUMENTS

| | | | |
|---|---|---|---|
| 829,344 | 8/1906 | Larsen | 254/DIG. 1 |
| 1,342,057 | 6/1920 | Miller | 254/DIG. 1 |
| 2,955,493 | 10/1960 | Olsen | 72/479 |
| 3,349,603 | 10/1967 | Lovig | 29/243.54 |
| 3,887,984 | 6/1975 | Erlichman | 29/243.53 |

*Primary Examiner*—James L. Jones, Jr.

*Attorney, Agent, or Firm*—Rogers, Eilers & Howell

[57] ABSTRACT

A rivet anvil for replacing rivets holding sickles, such as on hay and grass mowers, combines, and other machinery, while in the field, has a base with an upstanding rod. A rivet seat is formed in the top of the rod and is sized to accept and hold a rivet head while its post is peened. The anvil is relatively lightweight and can be carried with the machine.

1 Claim, 6 Drawing Figures

PORTABLE RIVET ANVIL

BACKGROUND AND SUMMARY OF THE INVENTION

For many years, farmers, highway departments, and others have been cutting large expanses of weeds and grass with tractor-drawn field mowers utilizing some sort of reciprocating sickle bar. It has been found that these machines are most efficient in cutting swaths of grass without leaving behind uncut areas. Other machinery, including combines and windrowers utilize the same sort of reciprocating sickle action and to simplify the application reference will be made to a sickle bar cutter throughout.

All of these machines perform satisfactorily as long as the sickles remain in place on the reciprocating bar. However, when the mower runs into small hidden obstructions such as tree stumps, rocks, or even small trees, the sickles have a tendency to break or jam and pop loose from their rivet mounting. Once this occurs, the mower or other device will fail to cut the area once covered by the damaged sickle so that an uncut row is left behind the mower. This is obviously undesirable; the mower must retrace its path with a different area of the bar to cut the uncut trail. Furthermore, some of the uncut grass will jam the sickle bar action. The best way to eliminate the problem is to replace the sickle on the reciprocating bar so that it will once again cut.

At least one device has been developed to replace sickles while the mower remains in the field. This device is disclosed in Olsen U.S. Pat. No. 2,955,494 issued Oct. 11, 1960. This device consists essentially of a hanger member supporting a see-saw bar with relatively large masses at either end of the bar. The heavier mass holds an end of the bar down which raises the other end with the smaller mass and the rivet post against the new rivet. The mass of each end helps absorb the shock of the hammer as the new rivet is peened against the rivet poast.

It has been found that the Olsen device is inconvenient for carrying along on a tractor or other farm machinery due to its bulk and weight. Also, due to the relatively complex structure and the amount of metal used in the device, it is undesirable from a cost standpoint as well.

Applicant has succeeded in developing a rivet anvil which will support the rivet as it is peened but with a much simpler structure using much less mass, making the device much more convenient to carry and relatively inexpensive by comparison. Applicant's device also retains the other advantages of the Olsen invention including freeing both hands of the operator for positioning the sickle and rivet while peening.

DESCRIPTION OF THE PREFERRED EMBODIMENT

Figure 1:
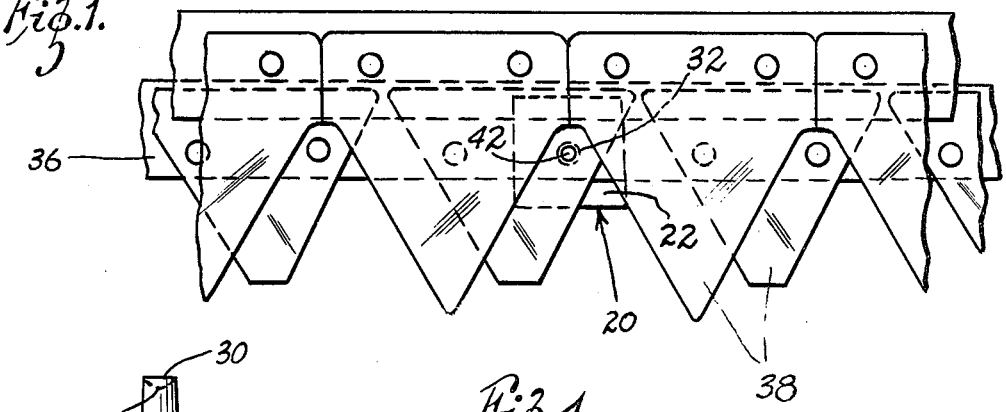
FIG. 1 is a plan view of a sickle bar with the anvil in place under a rivet.
Figure 2:
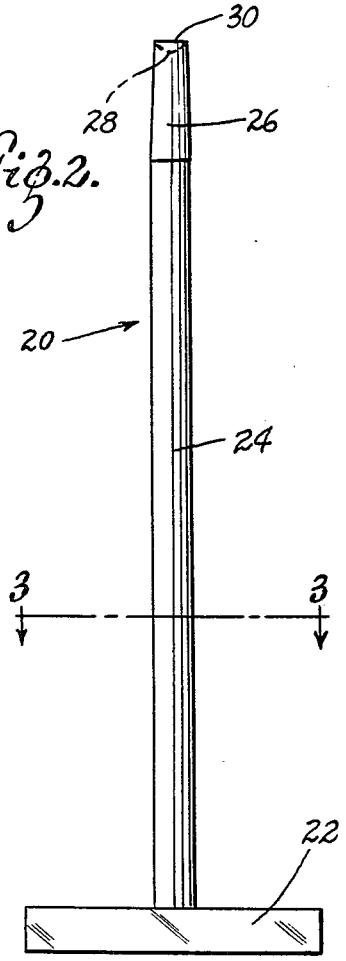
FIG. 2 is a side elevated view of the anvil.
Figure 4:
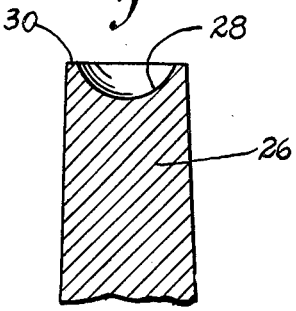
FIG. 4 is a side closeup view of the top of the anvil.
Figure 5:
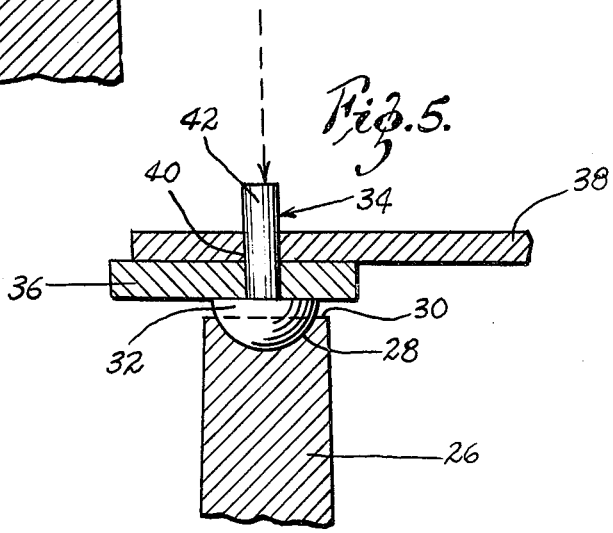
FIG. 5 is a closeup detail view of the rivet and anvil positioned for use.
Figure 3:
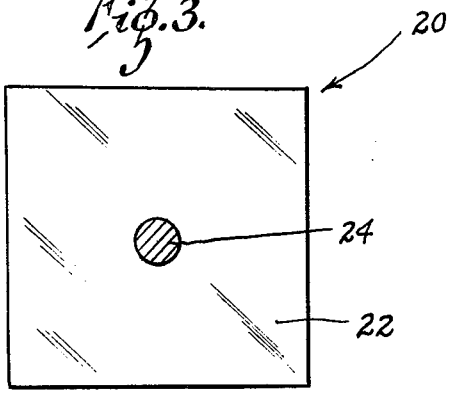
FIG. 3 is a top view of the anvil taken along lines 3—3 in FIG. 2.
Figure 6:
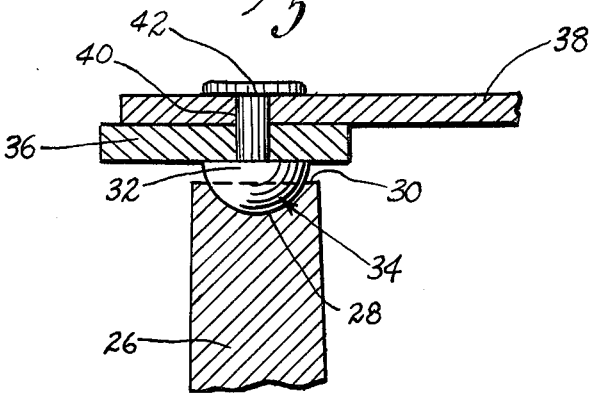
FIG. 6 is a detail view of the rivet and anvil after peening.

The rivet anvil 20 is an elegantly simple device consisting of a base 22 and a rod 24. The base 22 may be approximately four inches square by about 9/16ths inches thick as in the preferred embodiment. The base should be selected for each application depending upon the weight of the members being riveted together as well as the roughness of the surrounding terrain over which the anvil 20 is to be used. The base 22 should be of a size that will provide a firm support utilizing the mass of the earth to help absorb the peening blows. A rougher terrain may require a somewhat larger cross sectional area for the base 22.

The rod 24 may be attached to the approximate center of the base 22 by any conventional method of welding so as to provide a substantially rigid construction which will withstand the rough use accorded to farm implements. The rod 24 is approximately 12 inches in height in the preferred embodiment but would vary depending upon the expected height of the members being riveted. However, as the members being riveted normally are retractable, and their height off the ground therefore adjustable, a rod length of approximately 12 inches would be suitable for a large range of machines. The rod 24 is generally cylindrical with a slight taper for 2 or 3 inches at the top of the rod 24. This tapered section 26 aids in fitting the rod 24 between any supporting structure near the members being riveted. The taper 26 is not too extreme to weaken the end of the rod 24 and possibly become susceptible to breakage during the peening operation. The rod 24 may be constructed of ½ inch nominal steel bar stock or any other suitably inexpensive but strong metal. The rod 24 must be rigid enough so as to not substantially flex under the peening blows of an appropriately sized hammer. In the preferred embodiment, the taper 26 narrows the ½ inch nominal diameter of the rod 24 to approximately 3/8ths inch which is sufficient to withstand repeated riveting operations.

A rivet seat 28 is formed in the top surface 30 of the rod 24 and may be sized to accept any particular type or shape rivet head 32 as required for any particular machine. In the preferred embodiment, a semi-circular indentation of approximately ¼ inch has been found to work satisfactorily with most standard sized rivet heads 32. It has been found that the particular shape used for the rivet seat 28 is not critical as long as the rivet 34 is held stationary by the rivet seat 28 during the peening operation. While the heads 32 of most rivets 34 are sufficiently strong to withstand the peening blows even if the rivet head 32 does not fit snugly into the rivet seat 28, an optimal peening may be accomplished a greater percentage of the time if the rivet head 32 fits flush with the rivet seat 28 and the members being riveted are lowered so as to exert pressure against the anvil 20.

A typical operation using the rivet anvil 20 on a machine with a reciprocating bar 36 which is retractible may be as follows. The reciprocating bar 36 is first jogged to expose the rivet (not shown) which has been damaged. The damaged rivet (not shown) may be removed with a chisel and hammer or other equivalent tools. If the sickle 38 is separated from the machine, it should be set aside until ready to position a new rivet 34. The reciprocating bar 36 of the machine is then lifted or retracted away from the ground to allow space for the rivet anvil 20. The rivet anvil 20 should be positioned directly under the newly vacated rivet hole 40 and the reciprocating bar 36 lowered to a position just above the rivet anvil 20. A new rivet 34 should then be inserted up through the reciprocating bar 36 and the sickle 38 with the head 32 of the rivet 34 beneath the members being joined. The reciprocating bar 36 is then lowered very carefully so as to bring the head 32 of the rivet 34 into contact with the rivet seat 28 while maintaining the correct positioning of the members being riveted. For optimum riveting, some slight pressure should be applied by the reciprocating bar 36 downward on the rivet anvil 20 so as to force the rivet post 42 through the hole 40 as tightly as possible. This will also assure that the rivet 34 will be held stationary by the anvil 20 as the rivet head 32 will fit tightly into the rivet seat 28. In this position, it can be seen that the rivet anvil 20 and base 22 utilize the mass of the supporting earth to both hold the rivet 34 and supporting members in position as well as absorb the force of the peening blows by the hammer. Once in position, a hammer can then be used to peen the post 42 of the rivet 34 flatly against the supporting members. If during the peening operation, the post 42 of the rivet 34 is damaged so as to be unusable or if the post 42 is improperly peened, the rivet 34 can be chiseled out while the anvil 20 is in place. The reciprocating bar 36 would then be lifted a short distance off the anvil 20 so as to allow the damaged rivet (not shown) to be separated from the reciprocating bar 36. A new rivet 34 would then be positioned and the reciprocating bar 36 returned to come in contact again with the anvil 20 as described supra. Once the peening is accomplished, the reciprocating bar 36 would be lifted or retracted, the anvil 20 would be removed from the ground and returned to the machine for storage.

It can be appreciated by one skilled in the art that modifications and changes can be made without departing from the spirit and scope of the invention as defined in the appended claims. It is intended that the invention be limited in scope only by the appended claims.

What is claimed is:

1. A field anvil for supporting a rivet as it is peened to attach a sickle to a support bar at a location having a rough or soft terrain, such as an agricultural field, comprising: a base and an upstanding rod, the base being approximately square in shape with each side having a length approximately one-third the heighth of the rod and the base having a thickness of approximately one-eighth the length of a side to provide a substantial area compared with its mass to distribute the impact force applied to the anvil and effectively transmit the force to a support while firmly supporting the rod and preventing its flexing, the base thereby incorporating the mass of the earth on rough or soft terrain and maintaining the anvil and a rivet in a substantially fixed orientation with respect to a sickle and support bar during peening, the rod being approximately cylindrical and extending upwardly from the approximate center of the base and thereby distributing the impact load substantially equally across the full area of the base to prevent flexing of the rod during peening, the rod having a tapered section near its uppermost end to aid in fitting the rod against the rivet head and between any supporting structure surrounding the members being riveted without substantially weakening the rod or increasing its susceptibility to breakage during peening, the rod having a top surface, the taper terminating at the apex of the rod to circumscribe the top surface, the top surface being substantially flat and having means forming a curvilinear identation of approximately hemispherical shape with a diameter approximately two-thirds that of the top surface, the curvilinear indentation being adapted to receive less than all of the rivet head and sufficiently retain the rivet in a stationary mode relative to the sickle and support bar to thereby minimize the area of the top surface required and maximize the allowable taper, and the anvil thus being suitable for use with rivets having minimum clearance from other supporting structure.

* * * * *